US008939815B2

(12) United States Patent
Tsai et al.

(10) Patent No.: US 8,939,815 B2
(45) Date of Patent: Jan. 27, 2015

(54) SYSTEMS PROVIDING AN AIR ZONE FOR A CHUCKING STAGE

(75) Inventors: Hui-Ting Tsai, Tainan (TW); Feng-Inn Wu, Hsinchu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 736 days.

(21) Appl. No.: 13/031,344

(22) Filed: Feb. 21, 2011

(65) Prior Publication Data

US 2012/0214383 A1 Aug. 23, 2012

(51) Int. Cl.

| | |
|---|---|
| ***B24B 29/02*** | (2006.01) |
| ***B24B 5/02*** | (2006.01) |
| ***B24B 37/30*** | (2012.01) |
| ***B24B 37/32*** | (2012.01) |

(52) U.S. Cl.

CPC ..... *B24B 37/30* (2013.01); *B24B 37/32* (2013.01)

USPC ..... 451/287; 451/289; 451/398

(58) Field of Classification Search

CPC .. B25B 11/005; B24B 41/067; B24B 13/005; B24B 7/228; B24B 7/24; B24B 37/32

USPC ..... 279/3; 451/285, 286, 287, 288, 289, 451/290, 388, 398, 402

See application file for complete search history.

(56) References Cited

U.S. PATENT DOCUMENTS

| | | | | |
|---|---|---|---|---|
| 5,931,725 | A * | 8/1999 | Inaba et al. | 451/288 |
| 6,110,012 | A * | 8/2000 | Maury et al. | 451/36 |
| 6,336,846 | B1 * | 1/2002 | Park et al. | 451/41 |
| 6,419,567 | B1 * | 7/2002 | Glashauser | 451/259 |
| 6,540,594 | B2 * | 4/2003 | Zuniga et al. | 451/285 |
| 6,821,192 | B1 * | 11/2004 | Donohue | 451/285 |
| 6,893,332 | B2 * | 5/2005 | Castor | 451/288 |
| 6,988,932 | B2 * | 1/2006 | Ashjaee et al. | 451/5 |
| 7,101,271 | B2 * | 9/2006 | Moon | 451/285 |
| 7,294,040 | B2 * | 11/2007 | Moore | 451/8 |

* cited by examiner

*Primary Examiner* — Timothy V Eley

(74) *Attorney, Agent, or Firm* — Haynes and Boone, LLP

(57) ABSTRACT

A system includes a chuck with a retaining ring on a first surface thereof. The first surface and the retaining ring are both circular, the retaining ring having a first inner circumference. The system also includes a platen with a second surface, and the second surface faces the first surface and is operable to move with the first surface. The system further includes an air zone circumscribed by the first inner circumference that provides an effective inner circumference different from the first inner circumference.

19 Claims, 4 Drawing Sheets

SYSTEMS PROVIDING AN AIR ZONE FOR A CHUCKING STAGE

BACKGROUND

The present disclosure relates generally to a mechanical chuck with a retaining ring. Specifically, the present disclosure relates to systems and methods that provide an air zone at an inner diameter of a retaining ring within a chuck assembly.

Many conventional systems use a chuck assembly for Chemical Mechanical Polishing (CMP). The polishing head is on top, and it has a circular shape in the horizontal plane. Around the circumference of the polishing head is a retaining ring. A round semiconductor wafer is loaded into the chuck by using a vacuum to hold the wafer to the polishing head, where the wafer sits within the retaining ring. The chuck system is then closed by contacting the exposed surface of the wafer to a polishing pad on a platen. The wafer is then moved relative to the polishing pad to perform polishing.

In some embodiments the retaining ring is constructed of plastic. In conventional CMP systems, there is about 1 mm of clearance between the side of the wafer and the side of the retaining ring. In other words, the retaining ring is just a little larger in its inner diameter than is the wafer, and the purpose of this clearance is to facilitate loading of the wafer into the polishing head.

As a result of the clearance, the wafer moves relative to the retaining ring during polishing. Such movement leads to contact stress during CMP processes that causes pitting on the inner circumference of the retaining ring. If byproduct builds up in the pits, it can result in increased scratch defect possibility, increased bevel damage possibility, and lower yield. Accordingly, a more effective technique for CMP is called for.

SUMMARY

The present disclosure provides for many different embodiments. In a first embodiment, a system includes a chuck with a retaining ring on a first surface thereof. The first surface and the retaining ring are both circular, the retaining ring having a first inner circumference. The system also includes a platen with a second surface, and the second surface faces the first surface and is operable to move with the first surface. The system further includes an air zone circumscribed by the first inner circumference that provides an effective inner circumference different from the first inner circumference.

In another embodiment, a method for holding a manufactured object in a chucking stage includes loading the manufactured object into a chuck. The chuck includes a retaining ring that surrounds the manufactured object and has a first inner circumference larger than a circumference of the manufactured object. A difference between the first inner circumference and the circumference of the manufactured object provides a first clearance. The method also includes applying a vacuum at the chuck to hold the manufactured object to the chuck and applying air to an air zone between a circumference of the manufactured object and the first inner circumference of the retaining ring, thereby making an effective first clearance that is different than the first clearance.

In another embodiment, a system includes a chuck that has a vacuum system effective on a contact surface to hold a manufactured object to the chuck. The system further includes a retaining ring defining an area for holding the manufactured object to the contact surface, the retaining ring having a first inner circumference. The system also has means for applying pressurized air at the first inner circumference to reduce the first inner circumference to an effective inner circumference during a manufacturing process, the effective inner circumference being smaller than the first inner circumference.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
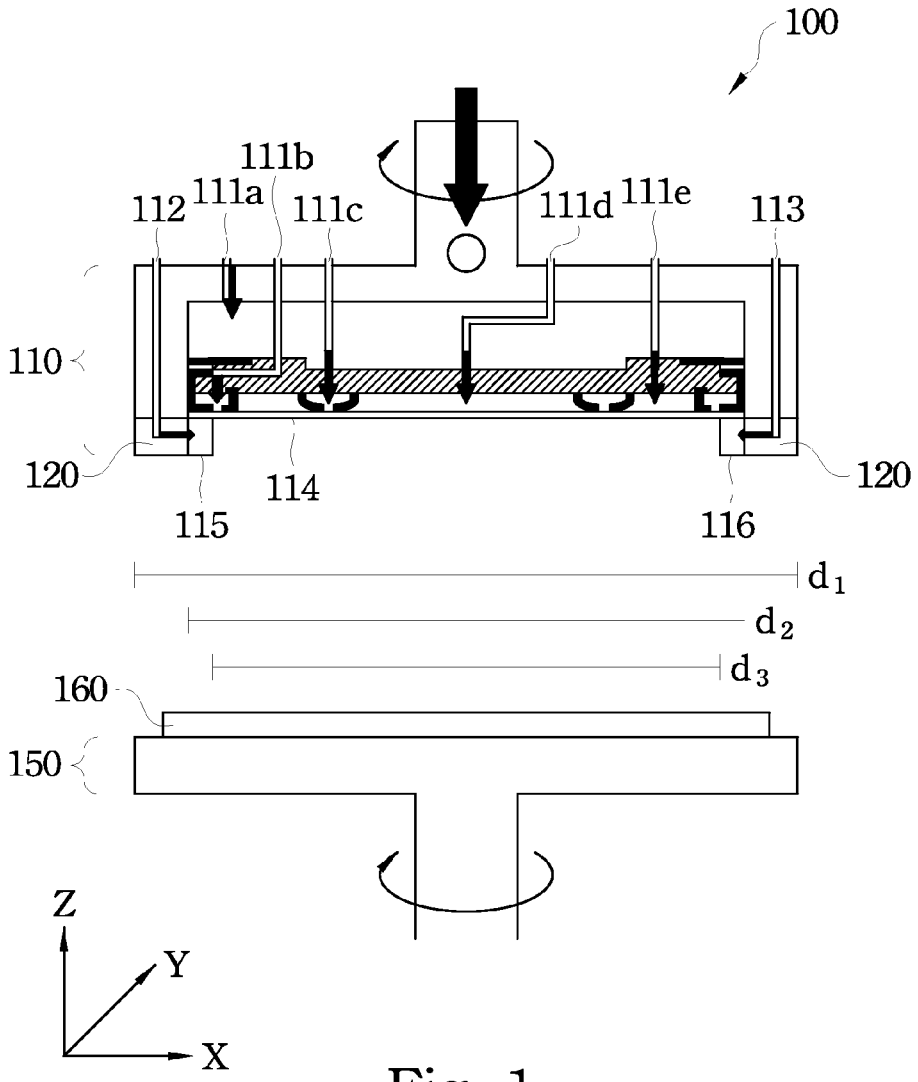
FIG. 1 is an illustration of an exemplary CMP system according to one embodiment.

The present disclosure relates generally to manufacturing processes. Specifically, the present disclosure relates to systems and method reducing a clearance between a retaining ring and a manufactured product circumscribed by the retaining ring. While the examples herein discuss applying the techniques to a CMP process, it is noted that the techniques discussed herein can be applied generally to systems and methods that use chuck systems, whether in the semiconductor industry or otherwise.

The following disclosure provides many different embodiments, or examples, for implementing different features of the invention. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

With reference now to the figures, FIG. 1 is an illustration of an exemplary CMP system 100 according to one embodiment. FIG. 1 shows a cross-section of polishing head or chuck 110 and platen 150. Polishing head 110 has an outer circumference illustrated in cross-section by diameter d1. Diameter d1 also corresponds in this example to an outer circumference of retaining ring 120. The inner circumference of retaining ring 120 is illustrated in cross-section by diameter d2.

Polishing head 110 also includes a vacuum assembly that has ports 111 and contact surface 114. Ports 111 are used to create a vacuum to hold a wafer (not shown) to contact surface 114. The ports 111 can also be used to neutralize the vacuum to "de-chuck" the wafer after a CMP process is completed.

Ports 112 and 113 provide air passageways through the body of polishing head 110 and retaining ring 120. Various embodiments apply pressurized air through ports 112 and 113 to create air zones 115 and 116, thereby creating an effective inner circumference of retaining ring 120 illustrated in cross-section by diameter d3. In various embodiments, polishing head 110 and retaining ring 120 may include more than two ports, similar to ports 112 and 113, that provide additional air zones around the inner circumference of retaining ring 120.

System 100 also includes platen 150 facing polishing head 110. Platen 150 includes thereon polishing pad 160, which when in use contacts the wafer held within the bounds of retaining ring 120. Polishing head 110 and platen 150 may move relative to each other, in the z-axis to make contact, and rotate within the x-y plane. In one example, as a polishing process begins, polishing head 110 and/or platen 150 move in the z-axis direction so as to contact the wafer with polishing pad 160. Polishing head 110 and/or platen 150 rotate so that there is abrasive motion applied to the wafer by polishing pad 160. Polishing head 110 and/or platen 150 may also have translating motion in the x-y plane to increase the uniformity of abrasion across the surface of the wafer. Moreover, the wafer may rotate around more than one axis so as to increase the uniformity of abrasion as well.

While not shown herein, system 100 may also include other pieces. For instance, other embodiments may include a pad conditioner, a slurry applicator, and the like, to facilitate CMP processes. Additionally, some embodiments include an air compressor/vacuum system in communication with ports 111-113 to provide vacuum for holding a wafer and for providing pressurized air in ports 112, 113. Moreover, some embodiments may include a control system to control the movements of the system and the positioning of the wafer. Furthermore, FIG. 1 is not shown to scale, and in some embodiments, the diameter of platen 150 may be several times larger than the outer diameter of polishing head 110.

Figure 2:
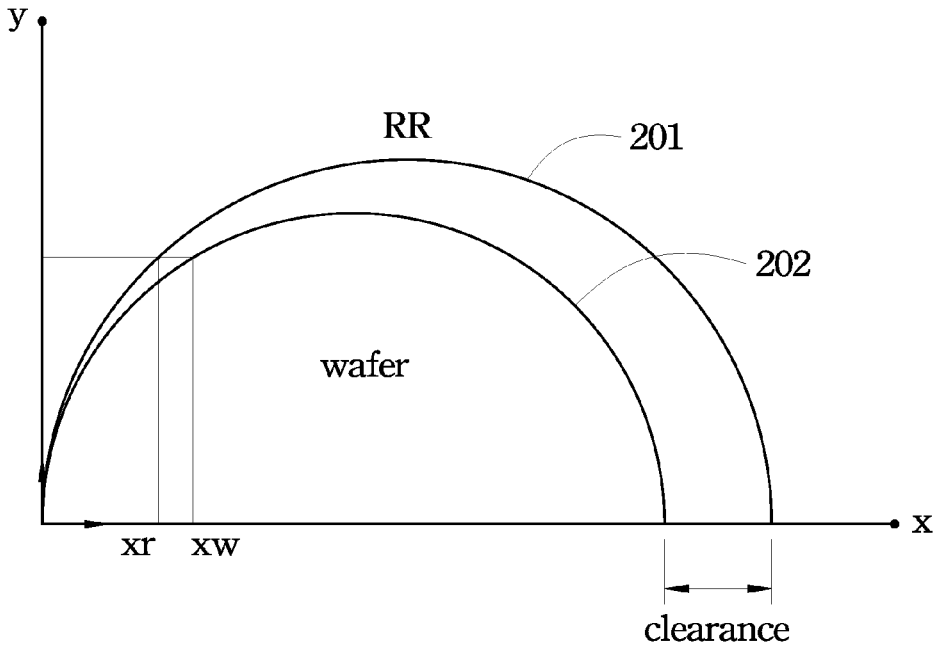
FIG. 2 is a conceptual top-down view not to scale showing a wafer circumference and a retaining ring inner circumference.

FIG. 2 is an illustration of the concept of clearance, which helps to explain how a wafer fits with respect to a retaining ring according to one embodiment. FIG. 2 is a conceptual top-down view not to scale showing wafer circumference 202 and retaining ring inner circumference 201. In some embodiments, 202 is smaller than 201, thereby allowing movement of the wafer relative to the retaining ring during the polishing process.

Clearance is shown in FIG. 2 as the maximum space between the wafer and the inner surface of the retaining ring. Various embodiments herein reduce the effective retaining ring inner diameter 201 to decrease clearance by using air zones during polishing. Such embodiments may reduce contact stress between the wafer and the retaining ring substantially enough to reduce pitting of the retaining ring. In one example, the effective inner circumference is reduced so as to reduce the clearance from 1 mm (typical of some conventional systems) to about 0.5 mm.

Figure 3:
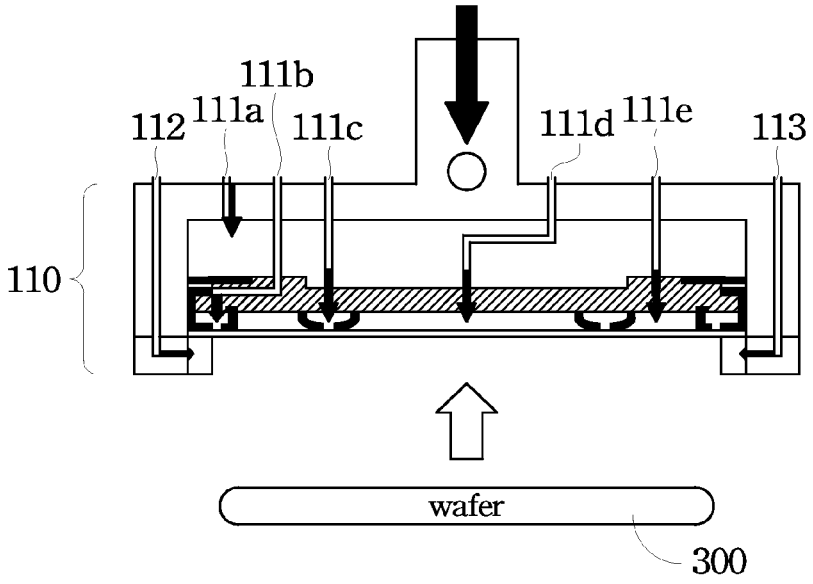
FIGS. 3-5 show the use of the polishing head of FIG. 1 according to one exemplary embodiment.
Figure 4:
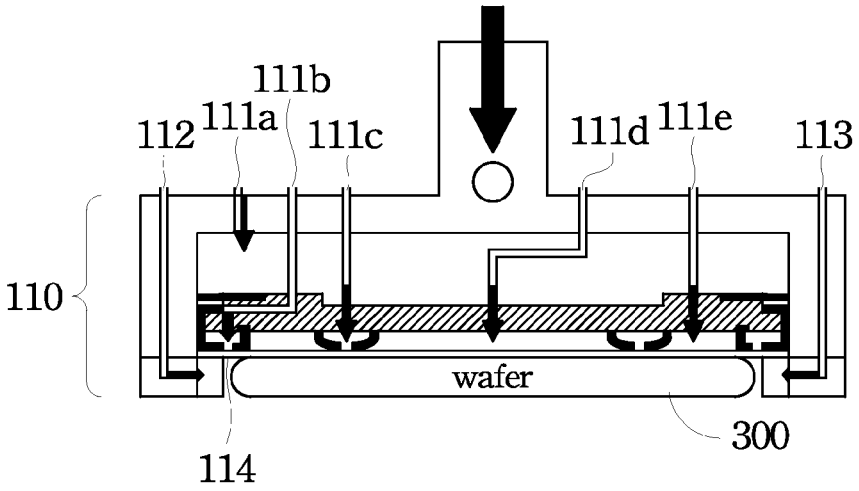
Figure 5:
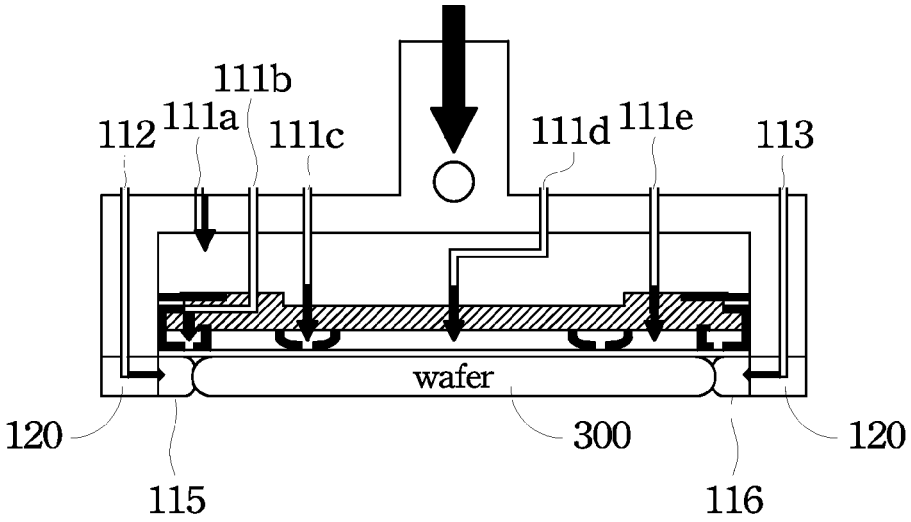

FIGS. 3-5 show the use of polishing head 110 according to one exemplary embodiment. In FIG. 3, wafer 300 is positioned under polishing head 110. In FIG. 4, vacuum is applied to hold wafer 300 to contact surface 114. While not shown in FIG. 4, some embodiments include small holes in contact surface 114 to expose wafer 300 to the vacuum and facilitate the hold in FIG. 4. Ports 111 are used to reduce the air pressure within polishing head 110 to supply the vacuum.

In FIG. 5, pressurized air is applied through ports 112, 113 to create air zones 115, 116 at the inner circumference of retaining ring 120. Air zones 115, 116 include air pressurized to higher than ambient pressure to exert some force against the sides of wafer 300, thereby reducing movement of wafer 300 during the polishing process. Thus, the pressurized air effectively reduces the inner circumference of retaining ring 120, thereby effectively reducing the clearance between the retaining ring 120 and wafer 300.

Furthermore, air zones 115, 116 create a "seamless" surface from the perspective of polishing pad 160 (FIG. 1). For example, without air zones 115, 116 the clearance between wafer 300 and retaining ring 120 creates a lack of smoothness where the polishing pad 160 contacts the gap formed by the clearance. However, air zones 115, 116 provide pressure at the gaps formed by the clearance, where the pressure affects the side of wafer 300 and the surface of the polishing pad as well. Air zones 115, 116 increase the smoothness so that the surface formed by retaining ring 120 and wafer 130 is approximately flush and smooth with respect to the polishing pad surface, even at the gaps between wafer 300 and retaining ring 120.

Figure 6:
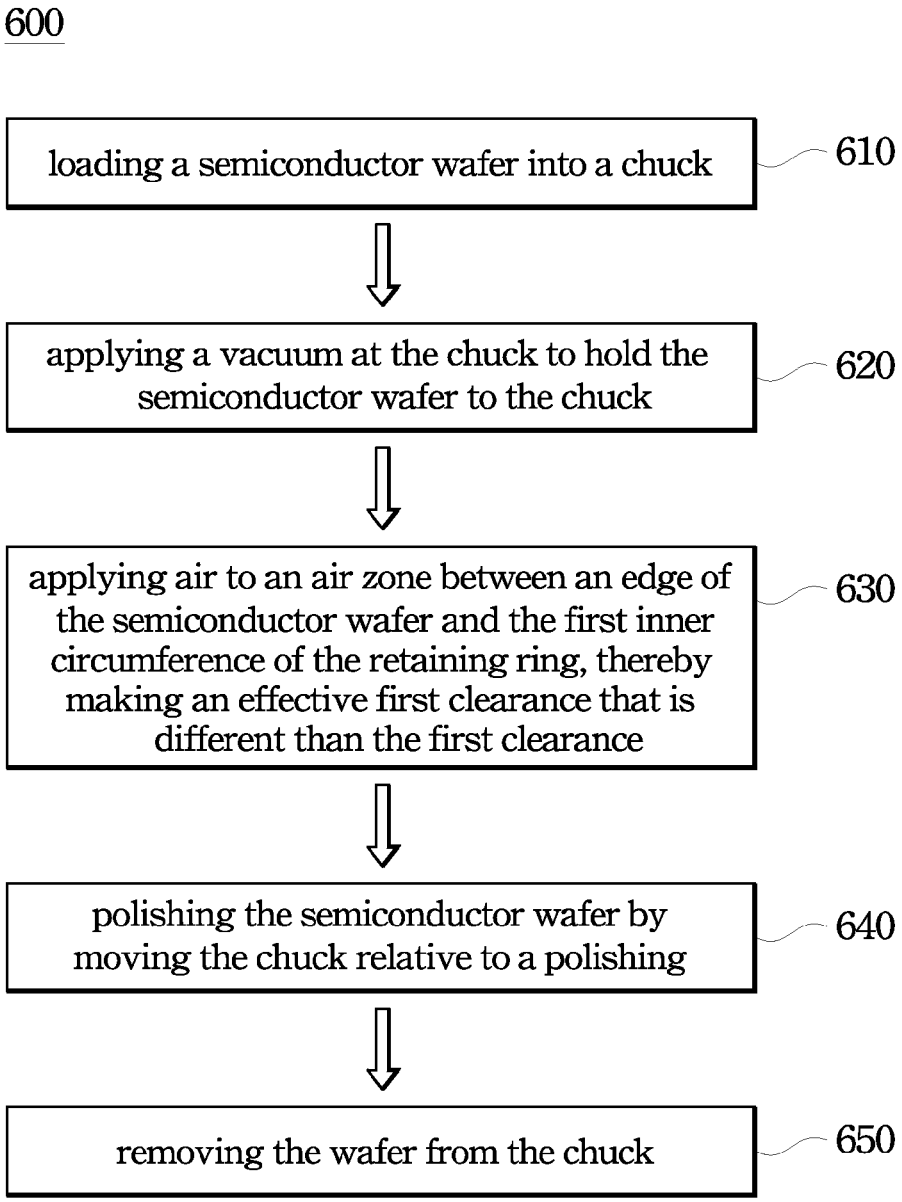
FIG. 6 is an illustration of an exemplary method for polishing a semiconductor wafer, according to one embodiment.

FIG. 6 is an illustration of exemplary method 600, for polishing a semiconductor wafer, according to one embodiment. Method 600 may be performed in some instances by one or more persons and/or machines in a single manufacturing site or multiple manufacturing sites.

In block 610, the wafer is loaded onto a chuck. In this example, the chuck has a retaining ring that has an inner diameter that is larger than the circumference of the wafer. The clearance between the retaining ring and the wafer allows for reliable loading of the wafer to the chuck. In some examples, the clearance is about one millimeter, though the scope of embodiments is not limited to any particular range of clearance.

In block 620, a vacuum is applied at the chuck to hold the semiconductor wafer to the chuck. For instance, as shown in FIGS. 3-5, a vacuum system with ports applies a vacuum through the ports to hold the wafer to a contact surface within the retaining ring.

In some embodiments, the vacuum system is controlled to keep the wafer at an even profile during the polishing process. Using FIG. 4 as an example, the wafer is shown edge-on and aligned in an x-y plane. However, it is possible that the wafer may become unaligned and tilt in the z-direction, which leads to uneven wear during polishing. In some embodiments, the profile alignment can be controlled using the vacuum ports so that by adjusting the vacuum at the various ports individually, a precise profile alignment can be achieved.

In block 630, an air zone is applied between the inner circumference of the retaining ring and the edge of the wafer. The air zone applies a force to the edge of the wafer, effectively reducing the inner circumference of the retaining ring and effectively reducing the clearance. In one example, the clearance is reduced to one-half millimeter, though the scope of embodiments is not limited to any range of effective clearance.

As mentioned above, some embodiments control the profile of the wafer using the vacuum system so as to achieve an even polishing on the whole surface of the wafer. Some embodiments additionally use the air zones to add further control to the profile alignment by moving the wafer relative to the retaining ring in the x-y plane.

While the examples herein refer to an air zone, the scope of embodiments is not limited to using atmospheric air. Various embodiments may use any suitable gas in an appropriate pressure for reducing the effective clearance between the wafer and the retaining ring.

Block 640 includes in some embodiments polishing the semiconductor wafer by moving the chuck relative to a polishing surface. As the chuck moves, the wafer may also move relative to the retaining ring. The air zones operate to reduce such movement by applying force at the edges of the wafer in the x-y plane, thereby reducing contact stress. Furthermore, the air zones create a more smooth and even surface at the gap between the wafer and retaining ring.

In block 650, the wafer is removed from the chuck. For instance, in some embodiments the pressurized air at the air zones is eliminated, as is the vacuum at the contact surface of the chuck. When the pressure at the air zones returns to ambient pressure, the effective clearance returns to the original clearance, thereby facilitating reliable removal of the wafer.

Method 600 is exemplary, and the scope of embodiments is not limited only to that shown in FIG. 6. Other embodiments may add, omit, modify, or rearrange actions. For instance, some embodiments include further processing of the wafer, such as deposition, etching, and further polishing steps. In another example, a manufactured object is positioned in a chuck using air gaps, and the process does not include a semiconductor polishing process. For example, an optical disc (e.g., a DVD) may be held in place in a chuck assembly during one or more portions of the manufacturing process, and the object may be held using air zones as illustrated above. In fact, the scope of embodiments includes chucking any manufactured object for any of a variety of purposes.

Various embodiments may include advantages over other techniques that employ a retaining ring with no air zone. For instance, some embodiments provide an effectively seamless surface for contacting the polishing pad. Such surface may reduce contact stress between the wafer and the retaining ring. Reduced contact stress may help to increase the lifespan of a retaining ring.

Additionally, contact stress can lead to damage at the relatively thin edges of the wafer (i.e., bevel damage). Various embodiments reduce incidents of bevel damage by reducing the contact stress.

Furthermore, some embodiments may increase wafer profile control by providing additional adjustment in the x-y plane. In some instances, adding the air zone may increase the wafer profile control by two or more millimeters for some conventional-sized wafers (e.g., from 145 mm to 147 mm).

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A system comprising:

a chuck with a retaining ring on a first surface thereof, the first surface and the retaining ring being circular, the retaining ring having a first inner circumference;

a platen with a second surface, the second surface facing the first surface and operable to move with the first surface; and a port within the retaining ring, an opening of the port positioned to direct air at a circumferential edge of a wafer being secured by the chuck, the air forming an air zone circumscribed by the first inner circumference and providing an effective inner circumference different from the first inner circumference, the effective inner circumference being between the retaining ring and the wafer.

2. The system of claim 1, in which the system comprises a Chemical Mechanical Polishing (CMP) system.

3. The system of claim 1, in which the chuck comprises a vacuum system to apply a vacuum within the first inner circumference.

4. The system of claim 1, in which the first inner circumference accommodates a semiconductor wafer with 1 mm of clearance between the first inner circumference and the semiconductor wafer.

5. The system of claim 1 further comprising:

a polishing pad upon the second surface.

6. The system of claim 1 further comprising:

means for moving the chuck and the platen relative to each other.

7. The system of claim 1 further comprising a semiconductor wafer held to the chuck by a vacuum and circumscribed by the effective inner circumference.

8. A system comprising:

a chuck that has a vacuum system effective on a contact surface to hold a manufactured object to the chuck;

a retaining ring defining an area for holding the manufactured object to the contact surface, the retaining ring having a first inner circumference; and a port having an opening to direct air perpendicular to a circumferential edge of a wafer within the chuck, the port to apply pressurized air from the first inner circumference to reduce the first inner circumference to an effective inner circumference during a manufacturing process, the effective inner circumference being smaller than the first inner circumference, the effective inner circumference being between the retaining ring and the wafer.

9. The system of claim 8 further comprising:

a plurality of ports in the vacuum system to provide a vacuum to the contact surface.

10. The system of claim 8 in which the port extends from the first inner circumference through at least a portion of the chuck.

11. The system of claim 8 wherein the chuck comprises a polishing head.

12. A system comprising:

a chuck;

a retaining ring on a first surface of the chuck, the first surface and the retaining ring being circular, the retaining ring having a first inner circumference;

a platen with a second surface, the second surface facing the first surface and operable to move with the first surface; and a port to provide air through the retaining ring, the air to be directed at a space between the first inner circumference and circumferential edges of a wafer placed within the chuck, the air providing an effective inner circumference different from the first inner circumference, the effective inner circumference being between the retaining ring and the wafer.

13. The system of claim 12, wherein the air is pressurized.

14. The system of claim 12, wherein the port extends through at least a portion of the chuck to an inner surface of the retaining ring.

15. The system of claim 12, further comprising additional ports to apply a vacuum to a wafer within the chuck.

16. The system of claim 12, wherein the air creates an air zone that circumscribes a wafer within the chuck.

17. The system of claim 12, wherein the platen comprises a polishing pad.

18. The system of claim 17, wherein the system comprises a Chemical Mechanical Polishing (CMP) system.

19. The system of claim 12, wherein the first inner circumference accommodates the wafer with 1 mm of clearance between the first inner circumference and the wafer.

* * * * *